US007493691B2

(12) United States Patent
Christensen et al.

(10) Patent No.: US 7,493,691 B2
(45) Date of Patent: Feb. 24, 2009

(54) CO-MOLDING METALLIC-LINED PHENOLIC COMPONENTS

(75) Inventors: Donald J. Christensen, Phoenix, AZ (US); Jason A. Gratton, Chandler, AZ (US); George T. Woessner, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 619 days.

(21) Appl. No.: 10/851,973

(22) Filed: May 20, 2004

(65) Prior Publication Data

US 2005/0258043 A1 Nov. 24, 2005

(51) Int. Cl.
*B23P 15/00* (2006.01)

(52) U.S. Cl. ..... 29/890.01; 86/56

(58) Field of Classification Search ..... 86/56; 29/890.01; 60/257
See application file for complete search history.

(56) References Cited

U.S. PATENT DOCUMENTS 3,022,230 A * 2/1962 Fialkoff ..... 205/73
3,122,883 A * 3/1964 Terner ..... 428/34.6
3,132,478 A * 5/1964 Thielman ..... 239/265.23
3,427,698 A * 2/1969 Guzewicz ..... 29/890.01
3,467,583 A * 9/1969 Naimer ..... 205/73
3,707,916 A 1/1973 Meraz, Jr. et al.
3,832,847 A * 9/1974 Butter et al. ..... 60/267
3,917,782 A * 11/1975 Holcombe et al. ..... 264/632
4,577,431 A * 3/1986 Siemers et al. ..... 42/76.02
4,927,714 A * 5/1990 Priceman ..... 428/628
4,938,824 A 7/1990 Youngkeit
4,942,653 A 7/1990 Hawkinson
5,012,853 A 5/1991 Bihlmaier
5,212,946 A 5/1993 Hans et al.
5,220,783 A 6/1993 Cherry et al.
5,223,045 A * 6/1993 Priceman ..... 148/268
5,233,755 A * 8/1993 Vandendriessche ..... 29/890.01
5,380,570 A 1/1995 Sayles
5,600,946 A 2/1997 Dombrowski et al.
5,613,299 A * 3/1997 Ring et al. ..... 29/890.01
5,800,753 A * 9/1998 Donadio ..... 264/81
5,855,828 A * 1/1999 Tuffias et al. ..... 264/29.1
6,079,202 A 6/2000 Cesaroni et al.
6,082,097 A 7/2000 Smith et al.
6,087,023 A * 7/2000 Tsantrizos et al. ..... 428/612
6,094,906 A 8/2000 Singer et al.
6,101,948 A 8/2000 Knaresboro et al.
6,164,060 A 12/2000 Myers et al.
6,195,984 B1 3/2001 Cornelius et al.
6,205,661 B1 * 3/2001 Ring ..... 29/890.01
6,296,723 B1 * 10/2001 Tsantrizos et al. ..... 148/522

(Continued)

*Primary Examiner*—Troy Chambers
(74) *Attorney, Agent, or Firm*—Ingrassia Fisher & Lorenz, P.C.

(57) ABSTRACT

A method is provided for manufacturing a missile component for use in a high temperature environment, where the missile component has a flow passage therethrough and the flow passage has a shape. An apparatus manufactured by the inventive method is provided as well. The method includes the steps of depositing a first metal onto a mandrel having the shape of the flow passage to create a first metal layer, applying an insulating material on to the first metal layer to create an insulating layer, machining a predetermined shape into at least a portion of the insulating layer, and applying a second metal onto the machined insulating layer to create an outer shell layer.

27 Claims, 4 Drawing Sheets

U.S. PATENT DOCUMENTS 6,314,720 B1 * 11/2001 Holmes et al. ..... 60/257
6,554,936 B1 4/2003 Metcalf et al.
6,582,542 B1 6/2003 Russell et al.
6,691,505 B2 2/2004 Harvey et al.
6,783,824 B2 * 8/2004 Steffier ..... 428/34.4
2004/0222571 A1 * 11/2004 Steffier ..... 264/602

* cited by examiner

CO-MOLDING METALLIC-LINED PHENOLIC COMPONENTS

FIELD OF THE INVENTION

The present invention relates to a missile component, and more particularly, a method of manufacturing the missile component.

BACKGROUND OF THE INVENTION

Different types of missiles have been produced in response to varying defense needs. Some missiles are designed for tactical uses, while others are designed for strategic uses. Typically, tactical missiles are relatively simple in design, may be produced in large quantities, and may be used for shorter flight missions. Strategic missiles, on the other hand, are employed for long duration operation and thus, are generally more complex in design. Strategic missiles may be relatively expensive to produce, and thus, produced in small quantities. As the demand for these types of missiles has risen, the desire for added capabilities has also increased. In particular, tactical and strategic missiles having precision guidance capabilities are now desired.

In the past, precision guidance systems have been used to guide launch vehicles and have been relatively expensive to produce. The high cost of manufacture has been due, in part, to the need to construct components from materials capable of withstanding high temperatures and erosion. In recent years, refractory metals have been used to construct the guidance system components, using conventional means and methods. For instance, the components have been formed or machined from refractory metals, or made in several pieces and subsequently adhered or welded together. These refractory metals are relatively heavy and expensive, and the use of large amounts of these metals has not been practical.

To defray costs, yet maintain the desirable properties of refractory metals, the system components have also been constructed from other materials, such as insulating materials, in conjunction with the refractory metals. Components manufactured by these materials are constructed by shaping the insulating material into a desired shape, shaping the refractory metal into an outer shell, and then coupling the shell to the shaped insulating material.

Although these methods have been sufficient for manufacturing precision guidance systems for use with launch vehicles, they have not been adequate for missile implementation. In particular, missiles are generally smaller than launch vehicles and thus, have space constraints. Conventional manufacturing methods have not been as successful in constructing high quality components having the requisite dimensions and complex shapes needed for desired precision guidance capabilities in these space constraints. Moreover, manufacturing costs of precision guidance systems are still high and inclusion of these costly methods in the manufacture of missiles increases the cost of the missiles.

Thus, there is a need for a method of manufacturing a missile that is cost-efficient and reliable. It is desirable to have a method for manufacturing a missile that may be implemented for mass production of precisely-dimensioned missile components. The present invention addresses one or more of these needs.

SUMMARY OF THE INVENTION

The present invention provides a method and apparatus for manufacturing a missile component for use in a high temperature environment where the missile component has a flow passage therethrough and the flow passage has a shape.

In one embodiment, and by way of example only, the method comprises the steps of depositing a first metal onto a mandrel having the shape of the flow passage to create a first metal layer, applying an insulating material on to the first metal layer to create an insulating layer, machining a predetermined shape into at least a portion of the insulating layer, and applying a second metal onto the machined insulating layer to create an outer shell layer.

An apparatus is also provided for use in a high temperature environment. The apparatus is a valve component that comprises an inner liner, wherein at least a portion of the inner liner comprises a refractory metal, an insulating layer coupled to the inner liner, and an outer shell coupled to the insulating layer.

Other independent features and advantages of the preferred method will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. For illustration purposes only, the invention is described herein as being used to manufacture a thrust assembly component that may be employed on a precision guidance missile, however, it will be understood that the method may be used to manufacture any component that may be exposed to extreme high temperatures, such as for tactical, strategic, or long range missiles, or any other type of thrust-propelled craft, such as spacecraft and torpedoes.

Figure 1:
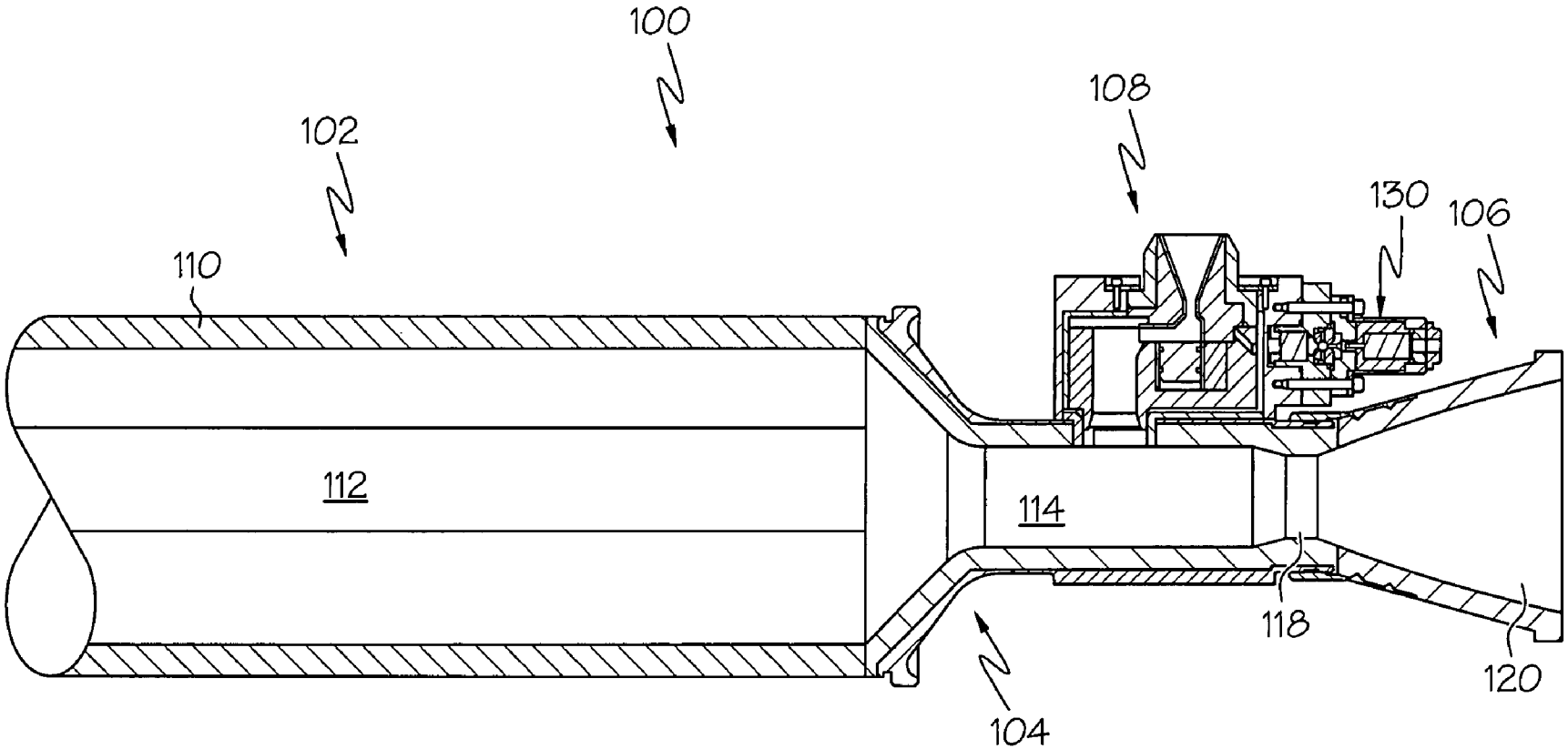
FIG. 1 is a cross section view of a propulsion section of a missile.

FIG. 1 is a cross section of a propulsion section of a missile. The propulsion section 100 includes a motor 102 and a blast tube 104 coupled to a nozzle 106. The blast tube 104 further includes at least one thrust assembly 108 that is coupled thereto and in fluid communication with the blast tube 104. Each of these components will now be described in further detail.

The motor 102 generally includes a tubular motor case 110 that defines a space within which a fuel source 112 may be disposed. The fuel source 112 may be any one of numerous types of fuels, including, but not limited to a solid fuel source. When the fuel source 112 is ignited within the motor case 110, propellant gases are produced and directed into the blast tube 104.

The blast tube 104 is generally cylindrical in shape and includes a channel 114 therethrough that is configured to receive the propellant gases from the motor 102. In the depicted embodiment, a portion of the propellant gases are directed through the blast tube 104 to the nozzle 106. As will be discussed more fully below, the remaining portion of the propellant gases are directed into the thrust assembly 108.

The nozzle 106 is coupled to the blast tube 104. In the depicted embodiment, the nozzle 106 is generally funnel-shaped and includes an inlet throat 118 in fluid communication with the blast tube 104 and an outlet 120 through which the propellant gases that enter the nozzle 106 may escape. When the propellant gases escape through the outlet 120, thrust is generated that propels the missile.

Figure 1A:
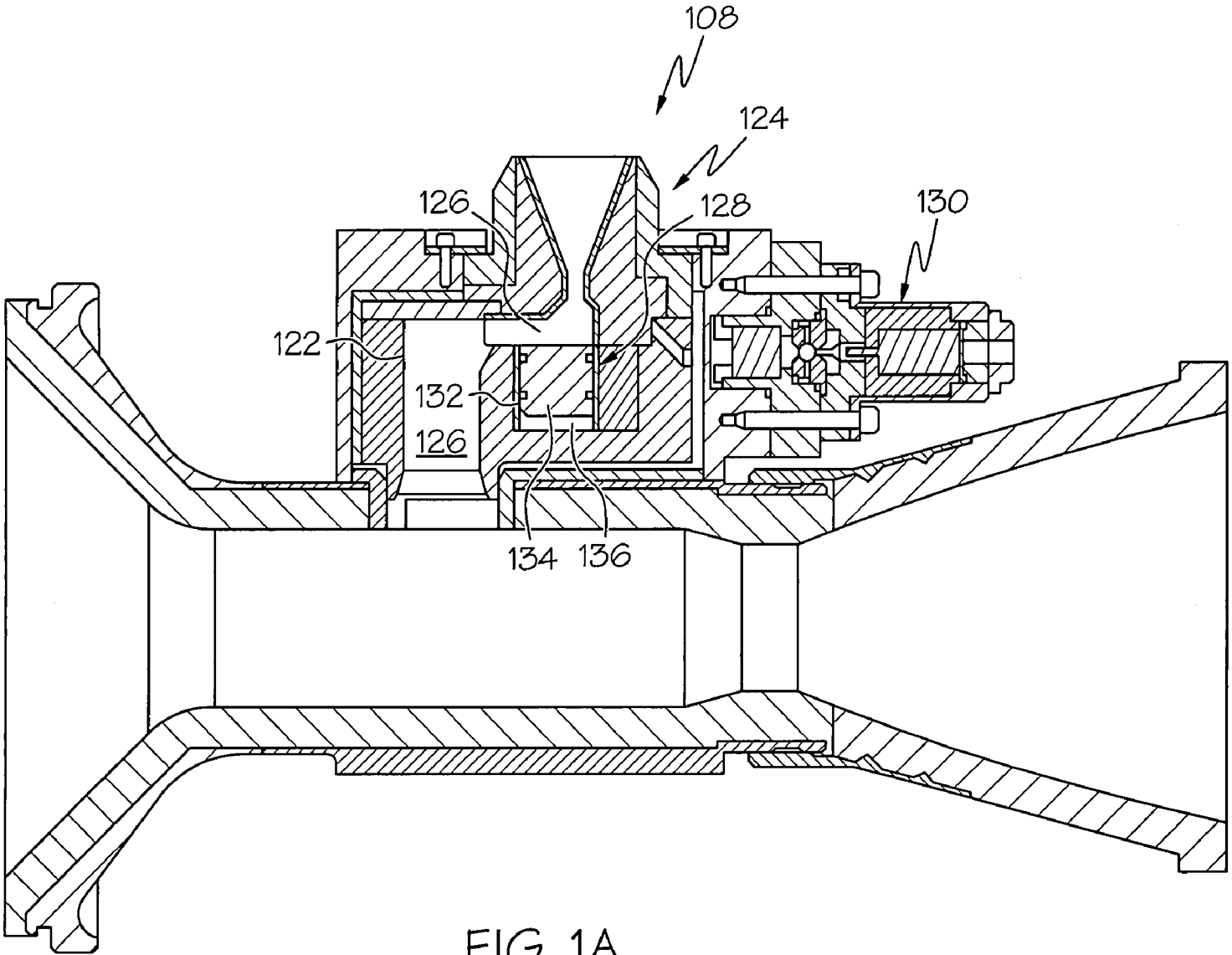
FIG. 1A is a close up view of a portion of the missile illustrated in FIG. 1.

As was noted above, another portion of the propellant gases produced in the motor 102 is directed to the thrust assembly 108. A close up of the thrust assembly 108 is provided in FIG. 1A. The thrust assembly 108 includes at least a main inlet duct 122 and a valve nozzle 124 through which a flow passage 126 is formed. The flow passage 126 is shaped to divert a portion of the propellant gases from one direction to at least another. The flow passage 126 shape may also be configured to provide fine control of the pitch, yaw, roll, and thrust of an in-flight missile. In smaller missile configurations, the flow passage 126 may include any one of numerous shapes and any number of twists, turns, and bends, such as the two L-shaped bends and convergence/divergence shown in the FIG. 1A. However, it will be appreciated that any one of numerous other configurations that provide the desired lateral control of the missile may also be used.

The lateral direction of the missile may be further controlled by at least one valve. The valve is used to regulate the amount of gas that escapes out of the valve nozzle 124 by controlling gas flow through the flow passage 126. Any one of numerous types of valves configured to enable the opening and closing of the flow passage 126 may be employed. In the embodiment depicted in FIG. 1, two valves 128, 130 are employed. The first valve 128 includes a control chamber 132 having a piston 134 disposed therein that defines an expandable volume 136. The expandable volume 136 is in fluid communication with the second valve 130, which is also in fluid communication with the flow passage 126 via a non-illustrated gas supply annulus. When the second valve 130 is in an on position, the propellant gases in the flow passage 126 are directed through the gas supply annulus (not shown) to the second valve 130 and into the expandable volume 136. As pressure from the propellant gases is exerted on the piston 134, the piston 134 is moved out of the control chamber 130 and into the flow passage 126, thereby inhibiting gas flow through the valve nozzle 124. When the second valve 130 is in an off position, the pressure in the control chamber 132 is released through a side vent (not shown), causing the piston 134 to be moved into the control chamber 130, and out of the flow passage 126, thereby allowing gas flow through the valve nozzle 124.

When two or more thrust assemblies 108 are used on a missile, lateral movement control of the missile is further increased. In such instances, the thrust assemblies 108 are preferably spaced apart such that when a first thrust assembly 108 is in an open position and a second thrust assembly 108 is in a closed position, the missile is directed in a first direction. Likewise, if the first thrust assembly 108 is in a closed position and the second thrust assembly 108 is in an open position, the missile is directed in a second direction.

Figure 2:
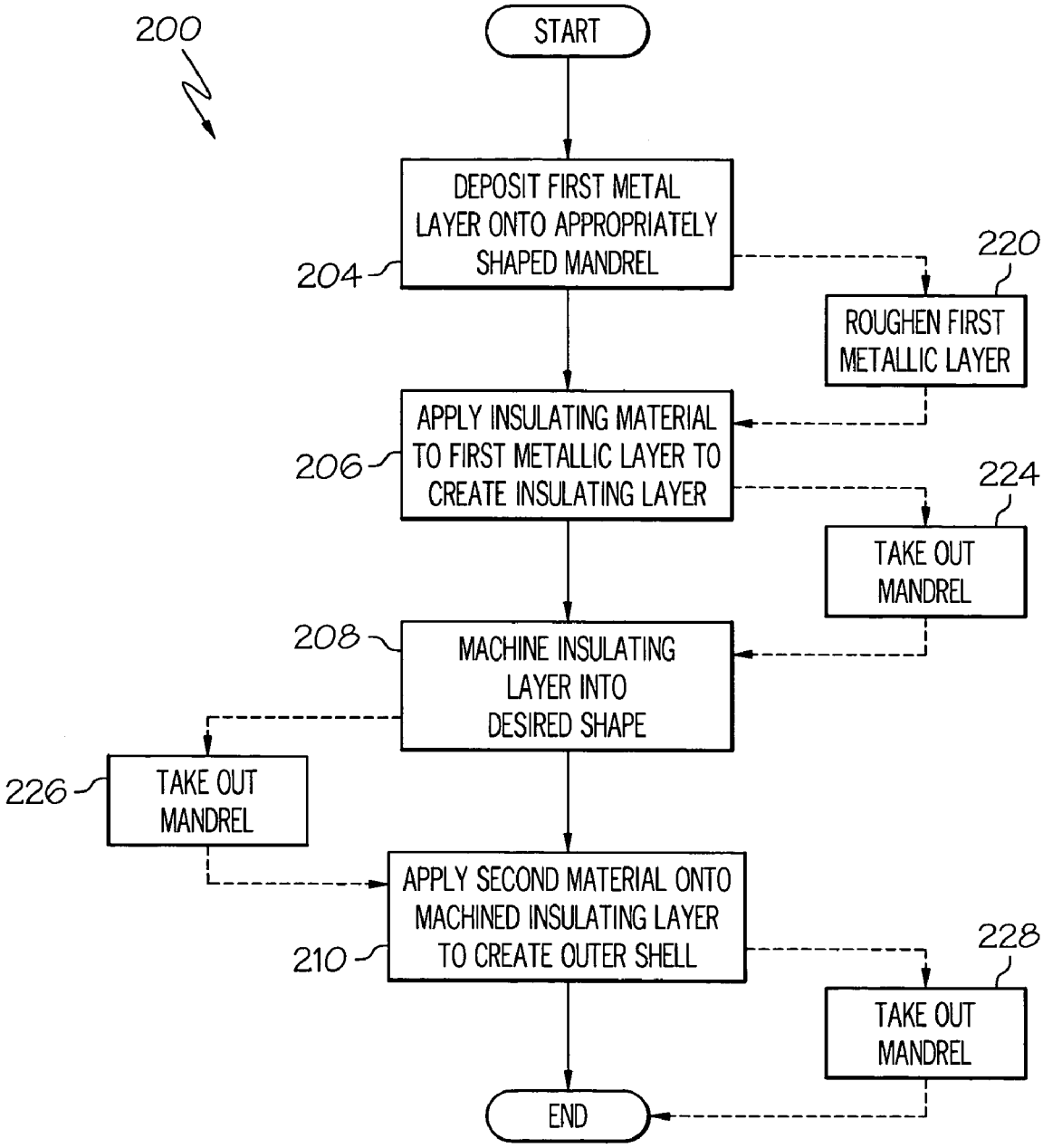
FIG. 2 is a flow chart illustrating a method of manufacturing a valve that may be implemented in the missile depicted in FIG. 1, according to one embodiment of the inventive method.
Figure 3:
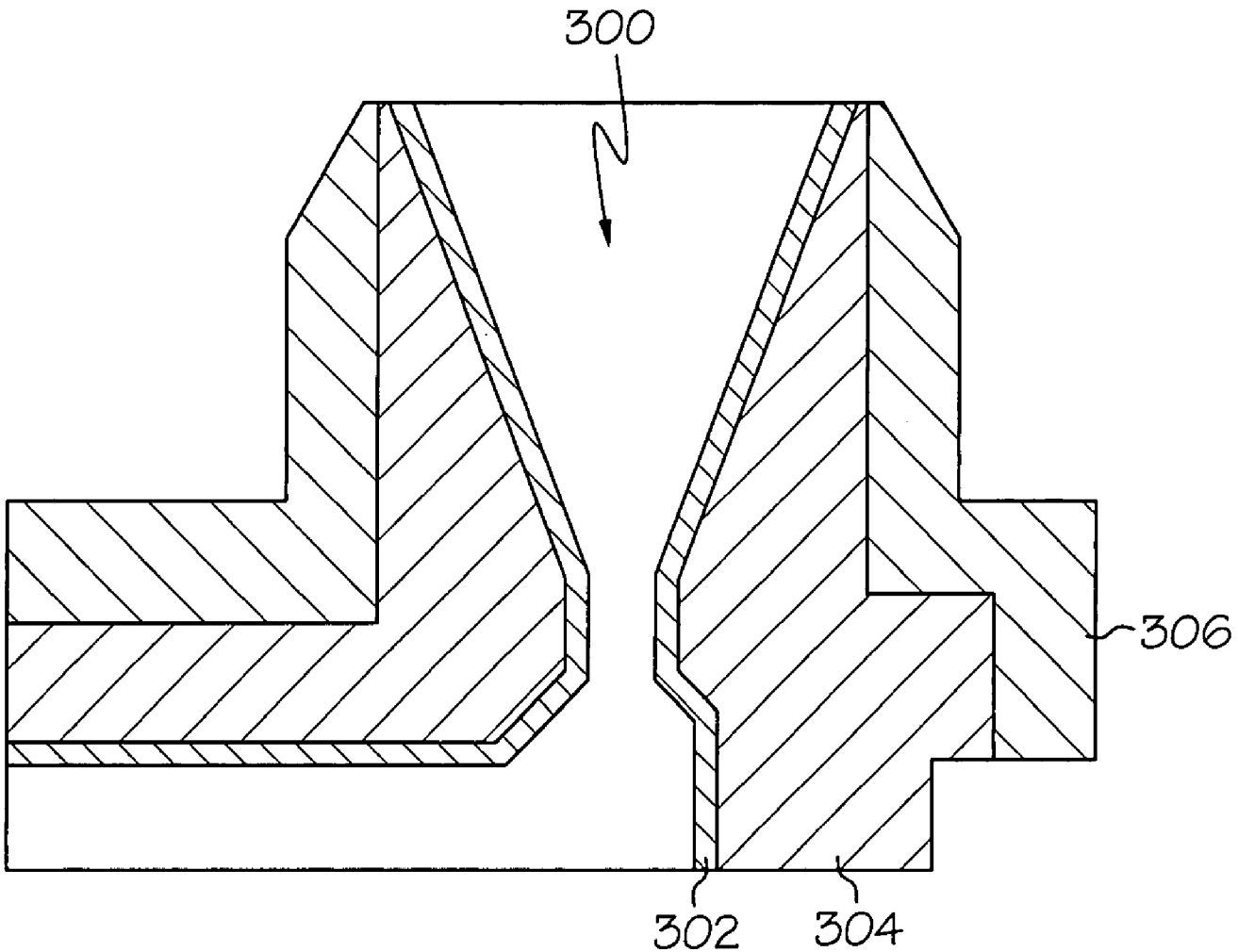
FIG. 3 is a cross section of a valve manufactured by an exemplary embodiment of the inventive method.

The flow passage 126, which as previously mentioned, extends at least partially through thrust assembly components such as the main inlet duct 122 and the valve nozzle 124, can have a complex shape and is in direct contact with the propellant gases. Consequently, the thrust assembly components that make up the flow passage 126 are preferably constructed according to the inventive method. With reference to FIGS. 2 and 3, for ease of explanation, the exemplary method will be described as applied to the construction of a valve nozzle 124.

The overall process 200 is illustrated in FIG. 2, and will first be described generally. First, a first metal layer 302 is deposited onto an appropriately shaped mandrel 300 (204). Then, an insulating layer 304 is applied to the first metal layer 302 (206), which is then machined into a desired shape (208). Thereafter, a second metal layer 306 is applied onto the machined insulating layer 304 (210). These steps will now be described in further detail below.

Before discussing the process steps in more detail, it will be appreciated that, the mandrel 300 is preferably a mold having a shape substantially identical to at least a portion of the flow passage 126 of the component to be constructed. Because various material layers are deposited onto mandrel 300 during at least a portion of the manufacturing process, the mandrel 300 is preferably made of a hard material capable of withstanding high pressures and capable of being mechanically or chemically removed from the interior of the component at some point during or at the completion of the process. Examples of suitable materials include, but not limited to, graphite, carbon-carbon, or molybdenum. The mandrel 300 may be machined, molded, or formed into the shape of the flow passage 126.

Returning now to a discussion of the process steps, as was noted above, the initial process step is the deposition of the first metal layer 302 onto the mandrel 300 (204). Preferably, the first metal layer 302 has a minimal thickness that may be determined by structural or erosion conditions of the thrust assembly 108. In one exemplary embodiment, the thickness of the first metal layer 302 is between about 0.001 and 0.100 inches. The first metal layer 302 serves as an inner liner of the component being constructed and may be deposited by any conventional known metal deposition method, such as, for example, by chemical vapor deposition, plasma etch chemical vapor deposition, or electroplating. Because the component will most likely be subjected to a harsh, high temperature environment, the first metal is preferably a material that can be shaped and then maintain its shape during exposure to extreme heat. Materials having erosion-resistance and the capability of withstanding thermal shock are preferable. Additionally, it is preferable that the materials have an operating capability at temperatures greater than about 5000° F., and more preferably, an operating capability at temperatures greater about 6000° F. In one embodiment, the first metal is a refractory metal, such as rhenium, tungsten, molybdenum, tantalum, niobium, and/or alloys of these or other refractory metals. In yet another embodiment, the first metal is a refractory metal alloy that contains refractory and non-refractory metals. In yet other embodiments, nickel or cobalt alloys are employed for use in environments having a temperature of less than 3000° F.

In another exemplary embodiment, the outer surface of the metal layer 302 is treated to improve the ability of subsequently deposited layers to adhere thereto. For example, the outer surface of the first metal layer 302 may be roughened (220), such as by buffing, chemical etching, or by uneven deposition of the first metal layer 302.

After the first metal layer 302 is formed, an insulating material is applied to the metal layer (206) to create the insulating layer 304. The insulating layer 304 may be any one of numerous known materials having insulating capabilities, such as phenolic, rubber, zirconia oxide, or ceramic-based coatings. For increased strength, glass or carbon fibers may be added to the insulating material.

The insulating layer 304 may be applied to the first metal layer 302 in any one of numerous fashions. In one exemplary embodiment, the insulating layer 304 is a phenolic layer made from a phenolic (pre-impregnated) mixture. To manufacture the phenolic layer, mandrel 300, having the first metal layer 302 deposited thereon, is placed in a container and phenolic mixture is packed around the mandrel 300 to cover the first metal layer 302 with the phenolic mixutre. The mandrel 300 is then heated and pressurized, which causes the phenolic mixture to activate and fuse into a lightweight solid insulating layer 304 that is coupled to the first metal layer 302.

After the insulating layer 304 is deposited or cured, it is then machined into a desired shape (208). Preferably, the insulating layer 304 is machined into the shape of the desired missile component, such as, for example, the flow passage 126. In the embodiment depicted in FIG. 3, the insulating layer 304 is machined into the shape of the valve nozzle 124. However, it will be appreciated by those with skill in the art that any one of numerous shapes that allows the component to be contained within the confined space of the missile may be machined into the insulating layer 304.

After the insulating layer 304 is appropriately shaped, a second metal layer is applied onto the insulating layer 304 to provide an outer shell 306 (210). The outer shell 306 improves the structural integrity of the component. The outer shell 306 may be constructed of any one of numerous types of conventional, relatively inexpensive metals, including but not limited to, aluminum, titanium, or steel, that may be used in the construction of a missile. Additionally, the outer shell 306 may be coupled to the component via any one of numerous conventional methods. In one exemplary embodiment of the method, the second metal is shaped into the desired shape of the component and then adhered to the machined insulating layer 304 by any one of numerous conventional methods, such as via epoxy resin or other structural adhesives. The outer shell 306 may be machined further to prepare the component for coupling to the missile.

In another embodiment of the inventive method, the mandrel 300 is removed at some point during the inventive method. The mandrel 300 may be removed after the insulating layer 304 is applied to the first metal layer 302 (224), after the insulating layer 304 is machined (226), after the outer shell 306 is created (228), or any other point during the inventive method.

The method by which the mandrel 300 is removed is, in large part, dependent upon the material from which the mandrel 300 is constructed. For instance, in one embodiment, the mandrel 300 is constructed with graphite, and is machined, chipped, or vibrated out from under the first metal layer 302 of the component to expose the flow passage 126. In another embodiment, the mandrel 300 is constructed with molybdenum and is chemically etched out of the flow passage 126 with an acid.

Thus, the resulting component manufactured by the inventive method is a lightweight and able to withstand and operate within a high temperature, pressurized environment. The resulting component includes an inner metal layer 302 that is capable of withstanding heat, retaining an original shape, and conducting the heat to an insulating layer 304. The insulating layer 304, which contains the heat therein, is covered with an outer shell 306 that provides additional structure to the component and that is protected from the heat source.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method for manufacturing a missile component for use in a high temperature environment, the missile component having a flow passage therethrough, wherein the flow passage has a shape, the method comprising:

depositing a first metal onto a mandrel having the shape of the flow passage to create a first metal layer;

packing an insulating material around the mandrel and the first metal layer while the mandrel is disposed in a container;

heating and pressurizing the mandrel to cause the insulating material to fuse into an insulating layer;

machining a predetermined shape into at least a portion of the insulating layer; and applying a second metal onto the machined insulating layer to create an outer shell layer.

2. The method of claim 1, wherein the step of depositing a first metal further comprises depositing between about 0.001-0.100 inches of the first metal.

3. The method of claim 1, wherein the first metal is erosion resistant and is capable of maintaining structural integrity at temperatures greater than about 3000° F.

4. The method of claim 1 wherein the first metal comprises a refractory metal.

5. The method of claim 4, wherein the refractory metal comprises rhenium.

6. The method of claim 1, wherein the step of depositing a first metal further comprises depositing the metal by chemical vapor deposition.

7. The method of claim 1, wherein the step of depositing a first metal further comprises electroplating the metal onto the mandrel.

8. The method of claim 1, wherein the insulating material is phenolic.

9. The method of claim 8, wherein the phenolic is a phenolic pre-impregnated mixture, the method further comprising:

covering the first metal layer with the phenolic mixture; and subjecting the phenolic-covered first metal layer to heat and pressure to thereby create the insulating layer.

10. The method of claim 1, wherein the step of applying a second metal comprises depositing between about 0.010-0.500 inches of second metal.

11. The method of claim 1, wherein the step of applying a second metal comprises:

shaping the second metal to a desired shape; and adhering the shaped second metal to the insulating layer.

12. The method of claim 1, wherein the second metal is selected from the group comprising aluminum, titanium, and steel.

13. The method of claim 1, further comprising:

removing the mandrel after machining the insulating layer.

14. The method of claim 1, further comprising:

removing the mandrel after applying the second material.

15. The method of claim 1, further comprising:

machining the outer shell to prepare the component to be coupled to a missile.

16. The method of claim 15, further comprising:

coupling the component to the missile.

17. The method of claim 1, further comprising:

roughening the first metal layer before depositing the insulating material.

18. A method for manufacturing a missile component for use in a high temperature environment, the component having a flow passage therethrough, the method comprising:

depositing a first metal onto a mandrel having a shape of the flow passage of the missile component to create a first metal layer;

packing an insulating material around the mandrel and the first metal layer while the mandrel is disposed in a container;

heating and pressurizing the mandrel to cause the insulating material to fuse into an insulating layer;

machining a predetermined shape into at least a portion of the insulating layer;

removing the mandrel after machining the insulating layer;

applying a second metal onto the machined insulating layer to create an outer shell; and machining the outer shell to be coupled to a missile.

19. The method of claim 18, wherein the step of depositing a first metal further comprises depositing between about 0.001-0.100 inches of the first metal.

20. The method of claim 18, wherein the first metal is erosion resistant and has an operating capability at temperatures greater than about 3000° F.

21. The method of claim 18, wherein the first metal comprises a refractory metal.

22. The method of claim 21, wherein the refractory metal comprises rhenium.

23. The method of claim 18, wherein the step of depositing a first metal further comprises depositing the metal by chemical vapor deposition.

24. The method of claim 18, wherein the step of depositing a first metal further comprises electroplating the metal onto the mandrel.

25. The method of claim 18, wherein the insulating material is phenolic.

26. The method of claim 25, wherein the phenolic is a phenolic preimpregnated mixture, the method further comprising:

covering the first metal layer with phenolic mixture; and subjecting the phenolic-covered first metal layer to heat and pressure to thereby create the insulating layer.

27. The method of claim 18, wherein the step of applying a second metal comprises depositing between about 0.010-0.500 inches of second metal.

* * * * *